US010661974B2

(12) United States Patent
Neumann et al.

(10) Patent No.: US 10,661,974 B2
(45) Date of Patent: May 26, 2020

(54) INTERNALLY FITTED AEROSOL DISPENSER

(71) Applicant: The Procter & Gamble Company, Cincinnati, OH (US)

(72) Inventors: Matthew Aaron Neumann, Montgomery, OH (US); Douglas Bruce Zeik, Liberty Township, OH (US); Scott Edward Smith, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 168 days.

(21) Appl. No.: 15/235,237

(22) Filed: Aug. 12, 2016

(65) Prior Publication Data

US 2018/0044096 A1 Feb. 15, 2018

(51) Int. Cl.

*B65D 83/38* (2006.01)
*B65D 83/62* (2006.01)
*B65D 83/44* (2006.01)

(52) U.S. Cl.

CPC ..... *B65D 83/38* (2013.01); *B65D 83/384* (2013.01); *B65D 83/44* (2013.01); *B65D 83/62* (2013.01)

(58) Field of Classification Search

CPC ..... B65D 83/38; B65D 83/384; B65D 83/44; B65D 83/62

See application file for complete search history.

(56) References Cited

U.S. PATENT DOCUMENTS

| | | | | |
|---|---|---|---|---|
| 2,863,699 A | | 12/1958 | Elser | |
| 3,270,920 A | | 9/1966 | Nessler | |
| 3,325,053 A | * | 6/1967 | DeBoer et al. | B67D 1/0412 137/116.5 |
| 3,333,743 A | * | 8/1967 | Meyers | B65D 83/38 222/402.1 |
| 3,343,730 A | * | 9/1967 | Nier | B65D 83/38 156/73.1 |
| 3,403,804 A | | 10/1968 | Roberto | |
| 3,433,134 A | | 3/1969 | Vellekoop | |
| 3,450,254 A | | 6/1969 | Miles | |
| 3,718,165 A | | 2/1973 | Grothoff | |
| 3,804,759 A | | 4/1974 | Becker et al. | |

(Continued)

FOREIGN PATENT DOCUMENTS

| | | |
|---|---|---|
| EP | 0179538 A2 | 4/1986 |
| EP | 0221562 A2 | 11/1986 |

(Continued)

OTHER PUBLICATIONS

PCT Search Report; dated Nov. 22, 2017; PCT/US2017/046390; 12 Pages.

(Continued)

*Primary Examiner* — Nicholas J. Weiss
(74) *Attorney, Agent, or Firm* — Sarah M DeCristofaro

(57) ABSTRACT

An aerosol dispenser having a valve cup. The valve cup has an internal interlock, for attachment of a valve assembly thereto. A seal is disposed below the interlock. This arrangement provides the benefit that components of the dispenser may be inserted past the interlock, and still seal product therein under pressure. The interlock may comprise threads or a bayonet fitting. The valve cup may be injection molded as a preform.

14 Claims, 3 Drawing Sheets

(56) References Cited

U.S. PATENT DOCUMENTS

| | | | | |
|---|---|---|---|---|
| 3,827,607 | A | 8/1974 | Schultz | |
| 3,961,113 | A * | 6/1976 | Marco | B29C 49/0078 428/36.92 |
| RE30,093 | E | 9/1979 | Burger | |
| 4,234,108 | A | 11/1980 | Diamond | |
| 4,330,066 | A * | 5/1982 | Berliner | B65D 23/00 215/12.1 |
| 4,463,056 | A * | 7/1984 | Steele | B29C 45/26 264/523 |
| 4,762,254 | A * | 8/1988 | Nitta | B65D 83/38 222/402.1 |
| 4,969,577 | A | 11/1990 | Werding | |
| 5,083,685 | A * | 1/1992 | Amemiya | B65D 83/38 222/402.1 |
| 5,127,556 | A | 7/1992 | Sporri | |
| 5,219,005 | A | 6/1993 | Stoffel | |
| 5,519,005 | A | 5/1996 | Lider | |
| 6,019,252 | A | 2/2000 | Benecke et al. | |
| 6,068,811 | A * | 5/2000 | Koda | B29C 45/2618 264/537 |
| 6,254,820 | B1 | 7/2001 | Cornell | |
| 6,499,311 | B2 | 12/2002 | Mahajan | |
| 6,649,121 | B1 | 11/2003 | Hamamoto et al. | |
| 7,028,866 | B2 | 4/2006 | Kunesh et al. | |
| 7,279,207 | B2 * | 10/2007 | Darr | B29C 49/0073 215/40 |
| 7,303,087 | B2 | 12/2007 | Flashinski et al. | |
| 7,810,675 | B2 | 10/2010 | Wheatley | |
| 8,074,847 | B2 | 12/2011 | Smith | |
| 8,096,327 | B2 | 1/2012 | Hirz | |
| 8,245,888 | B2 | 8/2012 | Andersen et al. | |
| 8,505,762 | B2 | 8/2013 | Holbach et al. | |
| 8,511,522 | B2 | 8/2013 | Chan et al. | |
| 8,752,731 | B2 | 6/2014 | Nimmo et al. | |
| 8,844,765 | B2 | 9/2014 | Tryon | |
| 8,851,322 | B2 | 10/2014 | Heineken | |
| 8,869,842 | B2 | 10/2014 | Smith | |
| 8,985,398 | B2 | 3/2015 | Demarest et al. | |
| 9,061,795 | B2 | 6/2015 | Girardot et al. | |
| 9,132,952 | B1 | 9/2015 | Knepp | |
| 9,132,955 | B2 | 9/2015 | Smith et al. | |
| 9,162,372 | B2 | 10/2015 | Van Hove et al. | |
| 9,221,596 | B2 | 12/2015 | Patel et al. | |
| 9,296,550 | B2 | 3/2016 | Smith et al. | |
| 9,701,430 | B2 | 7/2017 | Smith | |
| 2007/0145079 | A1 * | 6/2007 | Casamento | B65D 83/38 222/386.5 |
| 2009/0014679 | A1 | 1/2009 | Hygema et al. | |
| 2009/0045222 | A1 | 2/2009 | Nimmo | |
| 2009/0078902 | A1 * | 3/2009 | Flynn | B65D 83/46 251/149.8 |
| 2010/0264165 | A1 | 10/2010 | Hansen et al. | |
| 2011/0248035 | A1 | 10/2011 | Peirsman et al. | |
| 2012/0132607 | A1 | 5/2012 | Landman et al. | |
| 2013/0037580 | A1 * | 2/2013 | Armstrong | B29B 11/06 222/402.1 |
| 2015/0284117 | A1 | 10/2015 | Smith | |
| 2016/0176619 | A1 | 6/2016 | Smith | |
| 2017/0283158 | A1 * | 10/2017 | Schulz | B65D 83/0055 |
| 2018/0044096 | A1 | 12/2018 | Neumann et al. | |

FOREIGN PATENT DOCUMENTS

| | | | |
|---|---|---|---|
| EP | 0221563 | A2 | 5/1987 |
| EP | 1 801 030 | A2 | 1/2000 |
| EP | 2 930 125 | A1 | 1/2000 |
| EP | 2 481 688 | A1 | 8/2012 |
| WO | WO 91/08099 | A1 | 6/1991 |
| WO | WO 2004/083074 | A1 | 9/2004 |

OTHER PUBLICATIONS

PCT Search Report; dated Oct. 19, 2017; PCT/US2017/046389; 13 Pages.
All Office actions, U.S. Appl. No. 15/235,227.

* cited by examiner 20
26
22
23
25
4
51
24
29
40
30
55
42
3

INTERNALLY FITTED AEROSOL DISPENSER

FIELD OF THE INVENTION

The present invention relates to aerosol dispensers and methods of manufacture thereof.

BACKGROUND OF THE INVENTION

Aerosol dispensers are well known in the art. Aerosol dispensers typically comprise an outer container which acts as a frame for the remaining components and as a pressure vessel for propellant and product contained therein. Outer containers made of metal are well known in the art. However, metal containers can be undesirable due to high cost and limited recyclability. Attempts to use plastic have occurred in the art. Relevant attempts in the art to employ plastic in aerosol dispensers are found in U.S. Pat. Nos. 2,863,699; 3,333,743; 9,296,550 and 2009/0014679.

The outer containers are typically, but not necessarily, cylindrical. The outer container may comprise a bottom for resting on horizontal surfaces such as shelves, countertops, tables etc. The bottom of the outer container may comprise a re-entrant portion as shown in U.S. Pat. No. 3,403,804 or base cup as shown in U.S. Pat. No. 9,061,795. Sidewalls defining the shape of the outer container extend upwardly from the bottom to an open top.

The open top defines a neck for receiving additional components of the aerosol dispenser. The industry has generally settled upon a nominal neck diameter of 2.54 cm, for standardization of components among various manufacturers, although smaller diameters, such as 20 mm, are also used. Various neck shapes are shown in U.S. Pat. Nos. 6,019,252; 7,303,087; 7,028,866 and 7,279,207.

Typically a valve cup is inserted into the neck. The valve cup is sealed against the neck to prevent the escape of the propellant and loss of pressurization, such as described in U.S. Pat. Nos. 8,074,847; 8,096,327; 8,844,765 and 8,869,842. The valve cup holds the valve components which are movable in relationship to the balance of the aerosol dispenser. Suitable valves are shown in commonly assigned U.S. Pat. Nos. 8,511,522 and 9,132,955.

Aerosol dispensers, having a valve cup and movable valve components, may comprise different embodiments for holding, storing, and dispensing product used by the consumer. In one embodiment, the product and propellant are intermixed. When the user actuates the valve, the product and propellant are dispensed together. This embodiment may utilize a dip tube. The dip tube takes the product and propellant mixture from the bottom of the outer container. This embodiment may be used, for example, to dispense shaving cream foams.

Or, a collapsible, flexible bag may be sealed to the opening on the underside of the valve cup or may be placed between the valve cup and the container. This bag limits or even prevents intermixing of the contents of the bag and the components outside of the bag. Thus, product may be contained in the bag. Propellant may be disposed between the outside of the bag and the inside of the outer container. Upon actuation of the valve, a flow path out of the bag is created. This embodiment is commonly called a bag on valve and may be used, for example, in dispensing shaving cream gels. An aerosol container having a bag therein may be made from a dual layer preform, having plural layers disposed one inside the other. Relevant attempts in the art include U.S. Pat. Nos. 3,450,254; 4,330,066; 6,254,820; RE 30093 E; WO 9108099 and US 2011/0248035 A1.

But aerosol container having a bag on valve or dip tube configuration are not well suited to dispense high viscosity products. High viscosity products occur in many forms, such as mousse, toothpaste, caulk, shave gel, body lotion, shampoo, antiperspirant, etc. Pistons as disclosed in U.S. Pat. Nos. 3,433,134; 3,827,607; 4,234,108; 5,127,556; and 8,245,888 may be used if high viscosity products are dispensed.

If a valve is to be assembled into an aerosol, typically the valve cup is crimped on. But this operation is expensive and cannot be used with a plastic valve cup. Accordingly an interlock, may be used to attach a valve assembly to a valve cup, particularly a plastic valve assembly and plastic valve cup are used. A suitable valve may be according to U.S. Pat. No. 9,132,955. Suitable interlocks include bayonet fittings and threads. Yet other attempts in the art include U.S. Pat. Nos. 3,718,165; 3,804,759; 8,985,398; 9,132,952 and 9,221,596.

The interlock, particularly threads, may be internal or external to the valve cup. Internal threads have the advantage of less area, and proportionately greater blowout force resistance than, external threads. An internally fitted valve cup makes it more difficult to remove the valve therefrom, providing increased safety.

But sealing product in an aerosol having the valve attached to the valve cup via threads or a bayonet fitting presents other problems. For example, sealing is difficult as threads and bayonet fittings are usually not tight enough to prevent loss of pressure, yet loose enough for ease of assembly.

Accordingly, this application is directed to solving the problem of sealing a plastic valve to a plastic valve cup in an aerosol container.

SUMMARY OF THE INVENTION

The invention comprises an aerosol dispenser, an outer container therefor and a preform therefor in various embodiments, each having a neck. The neck has an internal interlock therein, which accepts a valve assembly. The interlock may comprise threads, a bayonet fitting, etc having an interlock diameter. A seal is disposed below the interlock and has a seal diameter which is less than the thread diameter.

BRIEF DESCRIPTION OF THE DRAWINGS

The drawings are to scale, unless otherwise noted.

DETAILED DESCRIPTION OF THE INVENTION

Figures 1, 2, 3, 4:
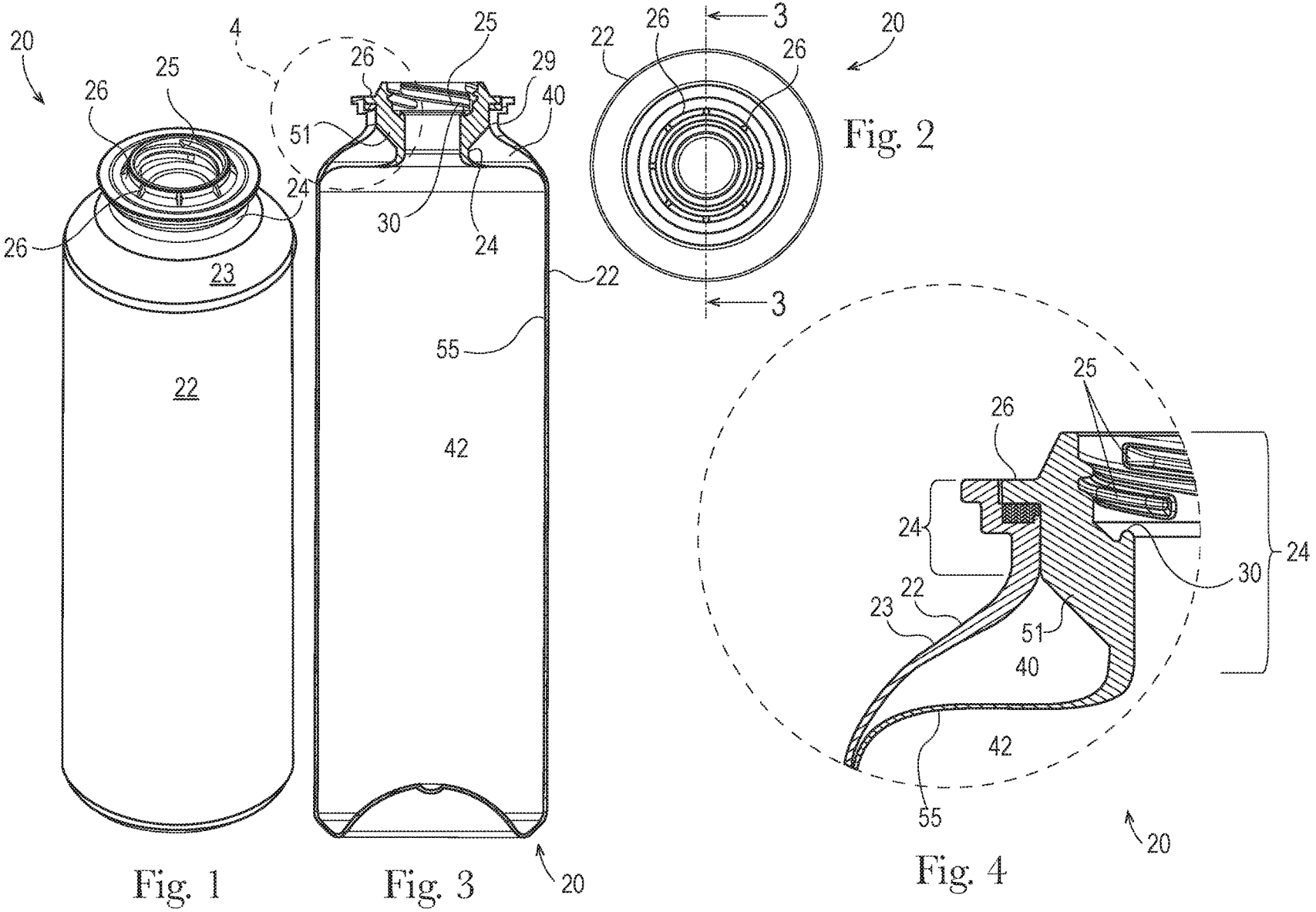
FIG. 1 is a perspective view of an aerosol container according to the present invention.
FIG. 2 is a top plan view of the aerosol container of FIG. 1.
FIG. 3 is a vertical sectional view of the aerosol container of FIG. 2, taken along line 3-3 of FIG. 2.
FIG. 4 is a partial, enlarged view of the aerosol dispenser of FIG. 3.

Referring to FIGS. 1 and 2, an aerosol container 20 having a longitudinal axis is shown. The aerosol container 20 comprises a pressurizeable outer container 22 usable for such a dispenser 20. The outer container 22 has a neck 24 into which a valve cup 26 is sealingly disposed. A valve assembly and actuator are disposed in the valve cup 26 for selective dispensing of product 42 from the dispenser 20. A seal 30 having a surface for sealing a valve assembly to the valve cup 26 is disposed below the valve cup 26 and valve assembly to prevent escape of product to ambient. As used herein, the terms aerosol dispenser 20 and aerosol container 20, can be used interchangeably, recognizing that an aerosol container 20 may be a subset of an aerosol dispenser 20, and have an outer container 22, valve cup 26 sealed thereto with a bag 55 joined to the valve cup 26, and optionally propellant 40, but not necessarily a valve assembly, actuator, labeling, etc.

As used herein, the top of the dispenser 20 or container 22 is taken as the uppermost part, when the dispenser 20 or container 22 is vertically oriented in its normal use or storage position. The terms 'above' and 'below' refer to relative positions towards and away from the top, respectively.

The outer container 22 may comprise metal or preferably plastic, as are known in the art. The plastic may be polymeric, and particularly comprise polyethylene terephthalate (PET) for all of the components described herein. The outer container 22 defines a longitudinal axis and may have an opening at one end thereof. The opening is typically at the top of the pressurizeable container when the pressurizeable container is in its-in use position. The opening defines a neck 24, to which other components may be sealingly joined.

As the top of the outer container 22 is approached, the outer container 22 may have a neck 24. The neck 24 may be connected to the container sidewall by a shoulder 23. The shoulder 23 may more particularly be joined to the sidewall by a radius. The shoulder 23 may have an annular flat. The neck 24 may have a greater thickness at the top of the outer container 22 than at lower portions of the neck 24 to provide a differential thickness. Such differential thickness may be accomplished through having an internally stepped neck 24 thickness.

A valve cup 26 may be sealed to the opening of the outer container 22, as described in further detail below. The valve cup 26 may be sealed to the neck 24 of the outer container 22 using the class 1 TPE material. Polyester based TPE sold by Kraiburg TPE GmbH & Co KG of Waldkraiburg, Germany under the name HTC8791-52 and by DuPont of Delaware under the name HYTEL may be used for good resistance to Silicone and adhesion to PET. Or a Styrenic bloc copolymer based TPE such as Kraiburg HTC8791-24 or Krayton elastomer may be used, providing easier process and lower density. Other seal materials include silicone, rubber and other conformable materials.

If desired, the valve cup 26 may be sealed to the container utilizing a press fit, interference fit, solvent welding, laser welding, vibration welding, spin welding, adhesive or any combination thereof. An intermediate component, such as a sleeve or connector may optionally be disposed intermediate the valve cup 26 and neck 24 or top of the outer container 22. Any such arrangement is suitable, so long as a seal adequate to maintain the pressure results.

A valve assembly, in turn, may be disposed within the valve cup 26. The valve assembly provides for retention of product 42 within the aerosol dispenser 20 until the product 42 is selectively dispensed by a user. The valve assembly may be selectively actuated by an actuator. A nozzle and related valve assembly components may optionally be included, depending upon the desired dispensing and spray characteristics. The valve assembly may be attached using conventional and known means. The valve assembly and actuator may be conventional and do not form part of the claimed invention.

Selective actuation of the valve assembly allows the user to dispense a desired quantity of the product 42 on demand. Illustrative and non-limiting products 42 include shave cream, shave foam, body sprays, body washes, perfumes, cleansers, air fresheners, astringents, foods, paint, etc.

A product delivery device may be used to contain and/or provide for delivery of product 42 from the dispenser 20 upon demand. Suitable product delivery devices comprise pistons, bags 55, dip tubes, and do not form part of the claimed invention, except as described herein.

The pressurizeable container may further include a propellant 40. The propellant 40 may comprise hydrocarbons, nitrogen, air and mixtures thereof. Propellant 40 listed in the US Federal Register 49 CFR 1.73.115, Class 2, Division 2.2 are also considered acceptable. The propellant 40 may particularly comprise a Trans-1,3,3,3-tetrafluoroprop-1-ene, and optionally a CAS number 1645-83-6 gas. One such propellant 40 is commercially available from Honeywell International of Morristown, N.J. under the trade name HFO-1234ze or SOLSTICE.

If desired, the propellant 40 may be condensable. Generally, the highest pressure occurs after the aerosol dispenser 20 is charged with product 42 but before the first dispensing of that product 42 by the user. A condensable propellant 40, when condensed, provides the benefit of a flatter depressurization curve at the vapor pressure, as product 42 is depleted during usage. A condensable propellant 40 also provides the benefit that a greater volume of gas may be placed into the container at a given pressure. A condensable propellant 40, such as HFO-1234ze, may be charged to a gage pressure of 100-400 kPa at 21 degrees C.

If desired, the outer container 22, valve cup 26, valve assembly, and/or piston may be polymeric. By polymeric it is meant that the component is formed of a material which is plastic, comprises polymers, and/or particularly polyolefin, polyester or nylons, and more particularly PET. Thus, the entire aerosol dispenser 20 or, specific components thereof, may be free of metal, allowing microwaving. Microwave heating of the aerosol dispenser 20 or pressurizable container therefor provides for heating of the product 42 prior to dispensing. Heating of the product 42 prior to dispensing may be desirable if the product 42 is applied to the skin, becomes more efficacious at lower viscosities, or is to be eaten.

The valve cup 26 may have a valve cup 26 periphery complementary to the neck 24 periphery. At least one of the valve cup 26 and/or container neck 24 may have one or more channels therethrough. Additionally or alternatively, the channels may be formed at the interface between the valve cup 26 and container neck 24. The channels may be formed by irregularities, such as crenulations, merlins, serrations, notches, teeth, etc. between valve cup 26 and/or container neck 24.

The outer container 22, and all other components, except the TPE seal, may comprise, consist essentially of or consist of PET, PEN, Nylon, EVOH or blends thereof to meet DOT SP 14223. Such materials may be selected from a single class of recyclable materials, as set forth above by the Society of Plastics Industry. The valve cup 26 and/or bag 55 may comprise plural layers such as nylon with EVOH and/or PET. Three layers may be utilized, such as PET/Nylon/PET or PET/EVOH/PET. The layers may be co-molded or overmolded. The multi-layer arrangements may provide increased barrier resistance and reduced failure rates.

If desired, the outer container 22, and/optionally the product delivery device, may be transparent or substantially transparent. This arrangement provides the benefit that the consumer knows when product 42 is nearing depletion and allows improved communication of product 42 attributes, such as color, viscosity, etc. Also, labeling or other decoration of the container may be more apparent if the background to which such decoration is applied is clear.

The outer container 22 may define a longitudinal axis of the aerosol container 20. The outer container 22 may be axisymmetric as shown, or, may be eccentric. While a round cross-section is shown, the invention is not so limited. The cross-section may be square, elliptical, irregular, etc. Furthermore, the cross section may be generally constant as shown, or may be variable. If a variable cross-section is selected, the outer container 22 may be barrel shaped, hourglass shaped, or monotonically tapered.

The outer container 22 may range from 6 to 60 cm, and particularly 10 to 40 cm in height, taken in the axial direction and from 3 to 60 cm, and particularly 4 to 10 cm in diameter if a round footprint is selected. The outer container 22 may have a volume ranging from 40 to 1000 cc exclusive of any components therein, such as a product delivery device. The outer container 22 may be injection stretch blow molded. If so, the injection stretch blow molding process may provide an overall stretch ratio of greater than 8, 8.5, 9, 9.5, 10, 12, 15 or 20 and less than 50, 40 or 30.

The outer container 22 may sit on a base. The base is disposed on the bottom of the outer container 22. Suitable bases include petaloid bases, champagne bases, hemispherical or other convex bases used in conjunction with a base cup. Or the outer container 22 may have a generally flat base with an optional punt.

A manifold may supply propellant 40, under pressure, through at least one channel between the valve cup 26 and container neck 24. The manifold may be retractingly disposed above the container 22. The manifold may be brought into contact with the valve cup 26, forming a temporary seal therebetween. Suitable channels are particularly described in commonly assigned U.S. Pat. No. 8,869,842 to Smith at FIG. 8, column 7, lines 57 to column 8, line 2 and column 8, lines 44-60. While the temporary seal is established between the manifold and valve cup 26, the propellant 40 may be charged into the 22.

The aerosol container 20, as presented to a user may have an initial pressure. The initial pressure is the highest pressure encountered for a particular filling operation, and corresponds to no product 42 yet being dispensed from the product delivery device. As product 42 is depleted, the outer container 22 approaches a final pressure. The final pressure corresponds to depletion of substantially all product 42, except for small residual, from the product delivery device. One benefit of the invention is that the residual product 42, remaining at end of life, is unexpectedly minimized.

This arrangement provides the benefit that propellant 40 may be charged to a lesser pressure than the desired starting pressure, decreasing propellant 40 charge time and reducing pressure applied to the charging machinery. Another benefit is that propellant 40 is disposed as needed for the end use when the aerosol dispenser 20 is ready for sale, product 42 fill and upon product 42 depletion may be recharged with product 42 and reused.

At 21 degrees C., the outer container 22 may be pressurized to an internal gage pressure of 100 to 1300, 110 to 490 or 270 to 420 kPa. A particular aerosol container 20 may have an initial propellant 40 pressure of 1100 kPA and a final propellant 40 pressure of 120 kPa, an initial propellant 40 pressure of 900 kPA and a final propellant 40 pressure of 300 kPa, an initial propellant 40 pressure of 500 kPA and a final propellant 40 pressure of 0 kPa, and any values therebetween.

If a permanent seal between components of the aerosol container 20 is desired, the seal may be welded. Particularly, if the components have compatible melt indices, such components may be sealed by welding to retain propellant therein. Suitable welding processes may include sonic, ultrasonic, spin, and laser welding. Welding may be accomplished with a commercially available welder, such as available from Branson Ultrasonics Corp. of Danbury, Conn. Alternatively or additionally, the channel may prophetically be blocked by a plug or sealed by adhesive bonding. Suitable sealing processes are particularly described in commonly assigned U.S. Pat. No. 8,869,842 to Smith at FIG. 9 and column 8, lines 30-43.

Referring to FIGS. 3-4 and examining the components in more detail, the valve cup 26 may be internally threaded. The threads 25 may or may not circumscribe the neck 24, as desired. One or more threads 25 may be utilized, with four threads 25, each thread 25 subtending about 90 degrees having been found suitable. The valve assembly may have complementary external threads. The valve is assembled into the valve cup 26 by screwing onto the complementary threads 25.

The assembly of the valve onto the valve cup 26 is intended to be permanent, although the valve may be replaced if desired. For example, the aerosol dispenser 20 may be refilled and reused with a different product 42, necessitating a new valve suitable for that particular product 42.

The valve cup 26 may have a seal 30. The seal 30 is between the inside of the valve cup 26 and valve assembly. The seal 30 prevents escape of product 42 and attendant propellant 40 if a dip tube configuration is used or escape of product 42 if a bag 55 is used.

The seal 30 is disposed below the threads 25. By 'below' it is meant the seal 30 is proximal to the base of the container 22 relative to the threads 25. That is, the seal 30 is preferably entirely disposed between the bottom thread 25 and the base of the container 22. The seal 30 is smaller in diameter than the threads, so that the complementary component, such as a valve, can be inserted through the threads 25.

This arrangement provides the benefit, not predicted by the art, that the seal is closer to the centerline of the container 22, reducing movement of the seal during pressurization and reducing attendant leakage. Also less seal 30 area is present, than sealing across the top or neck 24 of the container 22. But a relatively smaller diameter seal increases the moment arm from the outside of the container 22 to the seal 30, so that a relatively larger seal 30 diameter, may be desired. In any case, the seal 30 diameter is less than the thread 25 diameter.

The threads 25, or other interlock, are measured at the smallest respective diameter, often referred to as the thread land, as the smallest diameter control insertion of components through the valve cup 26. The seal 30 is measured at the largest diameter.

Measurement of diameters is done using a CT scan, an XM Series coordinate measuring machine, available from Keyence America of Itasca, Ill. or a caliper gauge as is available from the Starrett Company, of Athol, Mass. The diameters are measured in an unpressurized state.

The seal 30 provides a friction fit or compression fit against loss of pressurized product 42 and/or propellant 40 to ambient. The seal 30 may be smaller in diameter than the valve assembly, so that the seal 30 is compressed upon insertion of the valve. The seal 30 goes into compression due to compressive forces applied by the valve assembly when threaded or otherwise fitted into the neck 24. If desired particular material for the seal 30 may be co-injected with the valve cup 26.

The seal 30 may have a diameter of 7 to 23 mm and preferably 10 to 20 mm. The threads 25 may have a diameter of 10 to 30 mm, and preferably 15 to 25 mm. A thread 25 diameter of 18.3 mm and a seal 30 diameter of 13.6 mm have been found suitable. The ratio of thread 25 diameter to seal diameter may range from 1.1:1 to 1.5:1, and preferably from 1.3:1 to 1.4:1. The seal 30 may be longitudinally disposed at least 1 mm, particularly 1 to 5 mm below the lowest thread 25.

A thread 25 configuration having four threads 25 disposed 90 degrees out with each thread subtending 100 degrees, an 8.1 mm lead of axial travel in one turn, a 2.0 mm pitch between threads and a thread run-in with a 0.26 mm radius has been found to work well for an internal thread 25 diameter of 18.3 mm.

The threads 25 may be integrally molded with the container 22 or with the valve cup 26. This arrangement provides threads 25 within the neck 24 of the outer container 22, to accept a valve assembly. By integral it is meant that the threads 25 and substrate from which the threads 25 radially protrude are made together be unitary and cannot be separated with destruction or unintended gross deformation, and are preferably molded in the same operation.

This arrangement provides the benefit that the valve cup 26 and interlock can be made from a preform 60. A preform 60 can be made in a single injection molding operation, providing tolerances suitable for mass production. A first preform 60 is then blow molded in known fashion to make the outer container 22. The threads 25 are above the blow molding operation, preventing undue dimensional distortion thereof. A second preform 60 can be used to make the valve cup 26 as the finish and internal bag 55 as the body upon blow molding thereof. One of skill will understand the blow molding step may also include stretching as is known in the art.

This arrangement also provides the benefit a bag 55 can be used as the product delivery device. The bag 55 can be integral with the valve cup 26. By integral it is meant that the bag 55 and valve cup 26 are monolithic, molded at the same time or molded of two different materials melted together in a permanent manner. An integral bag 55 and valve cup 26 cannot be separated into two components without tearing or undue deformation. A container 22 made from a preform 60 using ISBM is referred to herein as a molded container 22.

One of skill will recognize the preform 60 may be used to make the outer container 22 or a bag 55 for use with the aerosol container 20 of this invention. One of skill will recognize a bag 55 is commonly used to contain product 42 and keep such product 42 isolated from the propellant 40.

Or the bag 55 may be directly attached to the valve cup 26. The bag 55 may be integrally injection molded with the valve cup 26. If the preform 60 is to be stretched into a bag 55, the preform 60 may have a wall thickness of 1 to 3 mm. The resulting bag 55 is collapsible upon depletion of product 42 therefrom. The resulting bag 55 may have a thickness of 0.07 to 0.2 mm.

Figure 6:
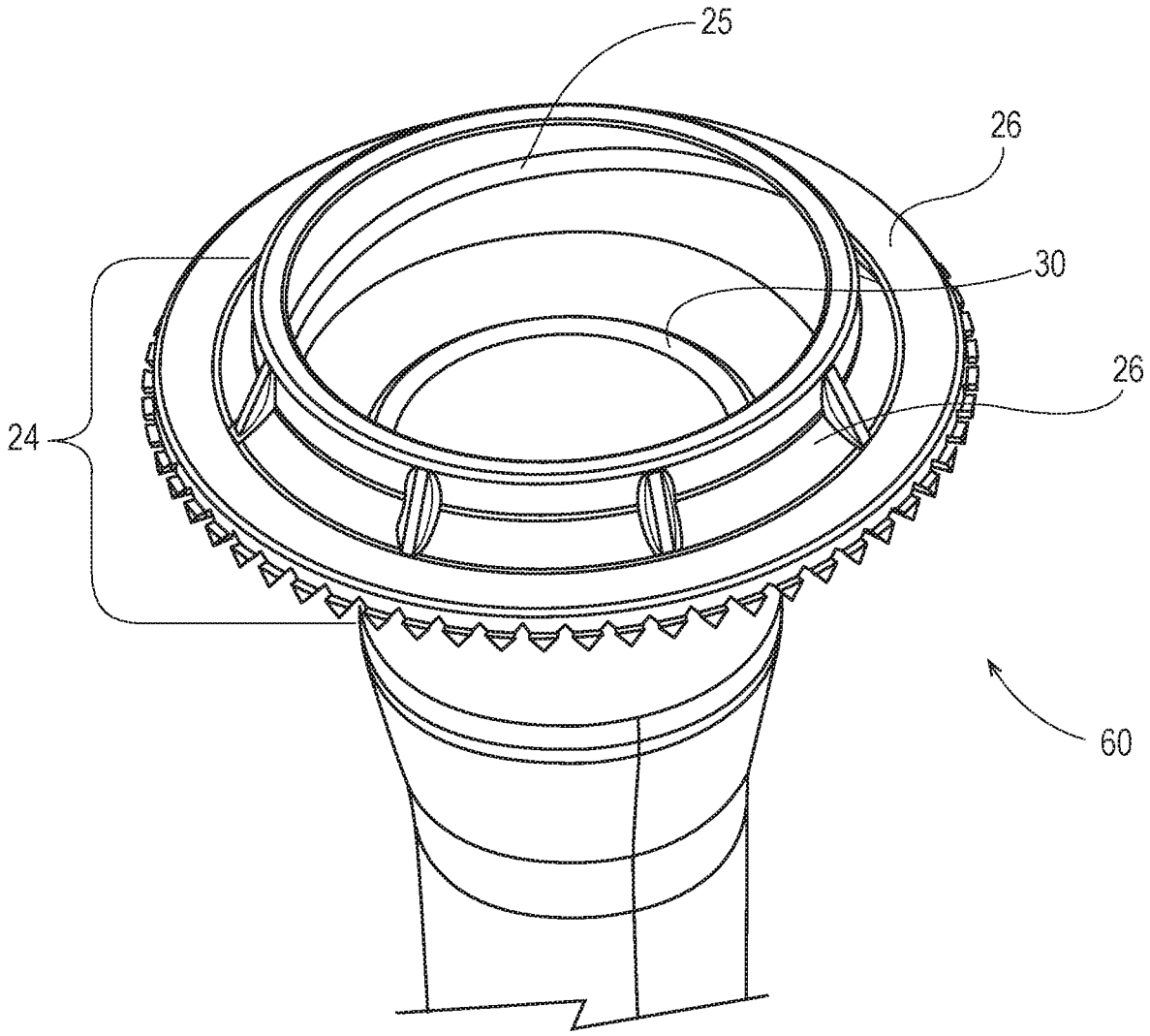
FIG. 6 is a fragmentary perspective view of a preform according to the present invention.

Referring to FIG. 6, if desired, the preform 60 may have one or more external ribs 51 thereon. The ribs 51 may be generally longitudinally oriented. The ribs 51 provide for plastic deformation when the second preform 60 is nested inside the first preform 60, so that the preforms 60 are held together by frictional engagement. The arrangement provides for ease of assembly to conduct the simultaneous blow molding step, so that both preforms 60 are blow molded together, saving manufacturing expense. Alternatively or additionally, the first preform 60 may have internal ribs 51, also providing a friction fit. Or the ribs 51 may be internal to the outer container 22.

Figure 5:
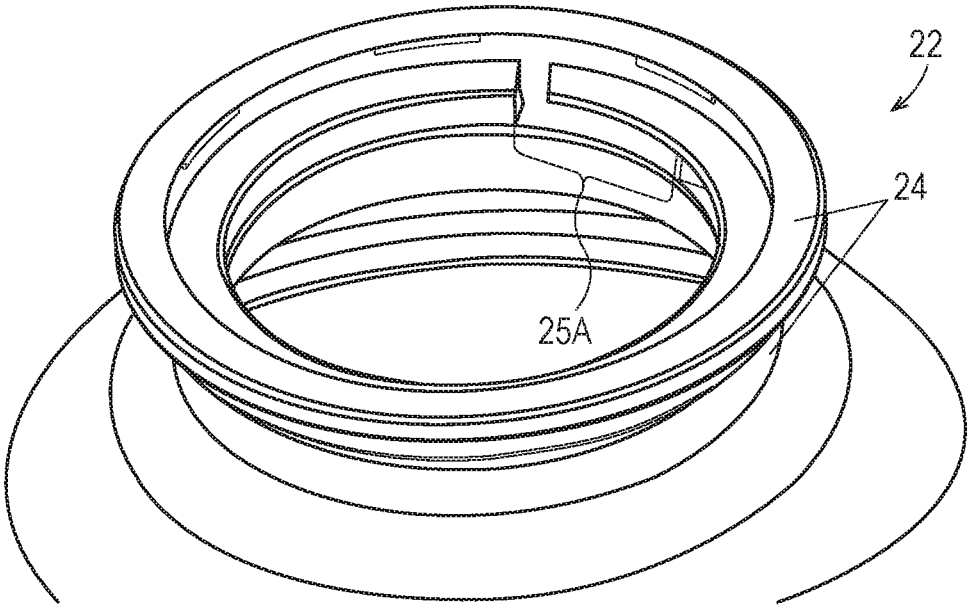
FIG. 5 is a fragmentary perspective view of an alternative embodiment of an outer container having a bayonet fitting interlock.

Referring to FIG. 5, in an alternative embodiment, the interlock can comprise a mechanical fitting, such as but not limited to a bayonet fitting 25A. The bayonet fitting 25A is an interlock which provides mechanical interference to prevent a complementary valve installed therein from being expelled under propellant 40 pressure. A suitable bayonet fitting 25A has a circumferential rotation of 60 to 120 degrees to seat the valve in place.

In variant embodiments, one of skill will understand that the invention includes configurations having plural bags 55. The plural bags 55 may be coaxial and optionally concentric. Or the plural bags 55 may be side-by-side. If desired, the bag(s) 55 may be pleated, and particularly longitudinally pleated, as is known in the art to provide for preferential collapse.

While the embodiments above show the valve cup 26 sealed to the top of the container 22, one of skill will realize the invention is not so limited. The valve cup 26 may also seal to the inside or outside of the neck 24 of the container 22. If desired, the valve cup 26 and preform 60 may be joined together from separate component parts via adhesive, welding as described above, etc.

The aerosol container 20 may be made by providing nested preforms 60 comprising an outer preform 60 and inner preform 60 disposed therein. The inner preform 60 has a valve cup 26 at the open end thereof. The preforms 60 are blowmolded together to form an outer container 22 and having an open end and an inner bag 55 depending therefrom towards the closed end of the outer container. Propellant 40 is charged between the bag 55 and outer container 22. The valve cup 26 is sealing joined to the open end of the outer container 22 to contain the propellant 40 therein and form an aerosol container. The aerosol container may then be stored as needed or directly shipped for product 42 fill, installing the valve assembly, actuator, label, etc.

Alternatively, inner bag 55/valve cup 26 combination and an outer container 22 and may be provided. The inner bag 55 is inserted in the open end of the outer container 22. Propellant 40 is charged between the bag 55 and outer container 22. As described above, the valve cup 26 is sealing joined to the open end of the outer container 22 to contain the propellant 40 therein and form an aerosol container. The aerosol container may then be stored as needed or directly shipped for product 42 fill, installing the valve assembly, actuator, label, etc.

One of skill will recognize the plural preform assembly of the invention may be used with trigger pump sprayers or finger pump sprayers, if an aerosol container is not desired. In a variant embodiment, a non-aerosol system using an elastically deformable band may be used, as described in commonly assigned U.S. Pat. No. 8,631,970. If so, the valve cup 26 is joined but not sealingly joined to the neck 24 of the outer container 22.

Combinations

A. A molded container for an aerosol dispenser, said molded container having a longitudinal axis defining a longitudinal direction, said molded container comprising:

an open neck and a closed end bottom longitudinally opposed thereto, a sidewall joining said neck and said bottom, said molded container having an inner surface and an outer surface, said neck having an internal interlock molded therein, said internal interlock having an interlock diameter; and a seal circumscribing said inner surface and having a seal diameter, said seal diameter being less than said interlock diameter;

said seal being longitudinally proximate to said closed bottom, relative to said internal interlock.

B. A molded container according to paragraph 1 wherein said interlock comprises at least one thread internal to said neck and having a thread diameter.

C. A molded container according to paragraphs A and B further comprising a step disposed on said inner surface of said container, said step having reduced cross section relative to said neck and said seal being disposed on said step.

D. A molded container according to paragraphs A, B and C having a seal thereon, whereby said seal goes into compression in response to screwing a complementary valve into said threads.

E. A molded container according to paragraphs A, B, C and D wherein said threads subtend less than 360 degrees.

F. A molded container according to paragraphs A, B, C, D and E wherein said thread diameter is 10 to 30 mm and said seal diameter is from 7 to 23 mm.

G. A molded container according to paragraphs A, B, C, D, E and F wherein the ratio of said thread diameter to said seal diameter is from 1.1:1 to 1.5:1.

H. A molded container according to paragraphs A, B, C, D, E, F and G wherein said seal is longitudinally disposed at least 1 mm below said threads.

I. A molded container for an aerosol container, said molded container having a longitudinal axis defining a longitudinal direction, said molded container comprising:

an open neck and a closed end bottom longitudinally opposed thereto, a sidewall joining said neck and said bottom, said molded container having an inner surface and an outer surface, said neck having an integral internal bayonet fitting molded therein, said internal bayonet fitting having a bayonet fitting diameter;

a seal circumscribing said inner surface and having a seal diameter, said seal diameter being less than said bayonet fitting diameter;

said seal being longitudinally proximate to said closed bottom, relative to said bayonet fitting.

J. A molded container according to paragraph I further comprising a valve disposed in said container, said valve being complementary to said bayonet fitting.

K. A molded container according to paragraphs I and J wherein said valve is disposed in said bayonet fitting with less than 360 degrees of rotation about said longitudinal axis.

L. A molded container according to paragraphs I, J and K further comprising a step below said bayonet fitting, said seal being disposed on said step.

M. A preform for an aerosol container, said preform having a longitudinal axis defining a longitudinal direction, said preform comprising:

an open neck and a closed end bottom longitudinally opposed thereto, a sidewall joining said neck and said bottom, said preform having an inner surface and an outer surface, said neck having an internal thread molded therein, said internal thread having a thread diameter; an integral seal circumscribing said inner surface and having a seal diameter, said seal diameter being less than said thread diameter; said seal being longitudinally proximate to said closed bottom, relative to said internal thread.

N. A preform according to paragraph M wherein said preform sidewall is adapted to be blown into a bag.

O. A preform according to paragraphs M and N wherein said neck is adapted to be usable as a valve cup in an aerosol dispenser.

P. A preform according to paragraphs M, N and O wherein said preform comprises an annular groove and said seal is disposed thereon.

Q. A preform according to paragraphs M, N, O and P further comprising a TPE material disposed on said seal.

R. A PET container according to paragraphs A, B, C, D, E, F, G, H, I, J, K and L further comprising a valve received in said neck thereof.

S. A preform according to paragraphs M, N, O, P and Q wherein said seal diameter is 2 to 8 mm less than said thread diameter.

T. A preform according to paragraphs M, N, O, P and S wherein said seal is disposed at least 1 mm below said threads.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" and a pressure disclosed as "about 1100 kPa" is intended to include 1103.2 kPa.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern. All limits shown herein as defining a range may be used with any other limit defining a range. That is the upper limit of one range may be used with the lower limit of another range, and vice versa.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aerosol dispenser comprising a molded container, said molded container having a longitudinal axis defining a longitudinal direction, said molded container comprising:

an open neck and a closed end bottom longitudinally opposed thereto, a sidewall joining said neck and said bottom, said molded container having an inner surface and an outer surface, a polymeric valve cup disposed within said neck, the valve cup comprising:

an internal interlock molded therein, said internal interlock having an interlock diameter; and a seal circumscribing said inner surface of said valve cup and having a seal diameter, wherein said seal diameter is less than said interlock diameter, and wherein said seal being longitudinally proximate to said closed bottom, relative to said internal interlock; and a bag integrally molded with the valve cup.

2. The aerosol dispenser of claim 1 wherein said interlock comprises at least one thread internal to said neck and having a thread diameter.

3. The aerosol dispenser of claim 2 comprising a step disposed on said inner surface of said container, said step having reduced cross section relative to said neck and said seal being disposed on said step.

4. The aerosol dispenser of claim 1 wherein said interlock comprising plural threads wherein said threads subtend less than 360 degrees.

5. The aerosol dispenser of claim 4 wherein said thread diameter is 10 to 30 mm and said seal diameter is from 7 to 23 mm.

6. The aerosol dispenser of claim 2 wherein the ratio of said thread diameter to said seal diameter is from 1.1:1 to 1.5:1.

7. The aerosol dispenser of claim 5 wherein said seal is longitudinally disposed at least 1 mm below said thread.

8. An aerosol dispenser comprising a molded container, said molded container having a longitudinal axis defining a longitudinal direction, said molded container comprising:

an open neck and a closed end bottom longitudinally opposed thereto, a sidewall joining said neck and said bottom, said molded container having an inner surface and an outer surface, a polymeric valve cup joined to said neck, said valve cup comprising an integral internal bayonet fitting molded therein and having a bayonet fitting diameter and a seal circumscribing said inner surface of said valve cup and having a seal diameter, wherein said seal diameter is less than said bayonet fitting diameter, and wherein said seal being longitudinally proximate to said closed bottom, relative to said bayonet fitting; and a bag integrally attached to the polymeric valve cup.

9. The aerosol dispenser of claim 8 comprising a step below said bayonet fitting, said seal being disposed on said step.

10. A preform for an aerosol dispenser, said preform having a longitudinal axis defining a longitudinal direction, said preform comprising:

an open neck and a closed end bottom longitudinally opposed thereto, a sidewall joining said neck and said bottom, said preform having an inner surface and an outer surface, said neck having an internal thread molded therein, said internal thread having a thread diameter;

an integral seal circumscribing said inner surface and having a seal diameter, said seal diameter being less than said thread diameter; and said seal being longitudinally proximate to said closed bottom, relative to said internal thread.

11. The preform of claim 10 wherein said preform sidewall is adapted to be blown into a bag.

12. The preform of claim 10 wherein said neck is adapted to be usable as a valve cup in an aerosol dispenser.

13. The preform of claim 10 wherein said seal diameter is 2 to 8 mm less than said thread diameter.

14. The preform of claim 10 wherein said seal is disposed at least 1 mm below said threads.

* * * * *